US005680781A

United States Patent [19]

Bonds et al.

[11] Patent Number: 5,680,781

[45] Date of Patent: Oct. 28, 1997

[54] HANDCUFF ESCORT ASSEMBLY

[76] Inventors: Edward E. Bonds, 1422 Herndon Dr., Weaver, Ala. 36277; Gary S. Hilburn, 212 Oak Rd., Anniston, Ala. 36206

[21] Appl. No.: 558,904

[22] Filed: Nov. 16, 1995

[51] Int. Cl.[6] ..... E05B 75/00

[52] U.S. Cl. ..... 70/16; 70/17

[58] Field of Search ..... 70/16, 17

[56] References Cited

U.S. PATENT DOCUMENTS

| | | | |
|---|---|---|---|
| 3,616,665 | 11/1971 | Rosenthal | 70/16 |
| 3,740,977 | 6/1973 | Stefansen et al. | 70/16 |
| 4,741,051 | 5/1988 | Bible | 70/16 X |
| 4,840,048 | 6/1989 | Elam | 70/16 |
| 4,909,051 | 3/1990 | Lee | 70/16 |
| 4,964,419 | 10/1990 | Karriker | 70/16 X |
| 5,007,257 | 4/1991 | Thompson | 70/16 |
| 5,031,641 | 7/1991 | Upton | 70/16 X |
| 5,233,848 | 8/1993 | Elam | 70/16 |
| 5,343,562 | 9/1994 | Bible | 70/16 X |
| 5,461,890 | 10/1995 | LeFavor | 70/16 |

FOREIGN PATENT DOCUMENTS

| | | | |
|---|---|---|---|
| 2268778 | 1/1994 | United Kingdom | 70/16 |

*Primary Examiner*—Suzanne Dino

*Attorney, Agent, or Firm*—Phillip A. Rein

[57] ABSTRACT

A handcuff escort assembly operable to be engageable with a conventional handcuff assembly or an economical handcuff assembly placed about a wrist area of a person being restrained. The handcuff escort assembly includes a handcuff receiver and locking assembly connected to a portion of the handcuff assembly and having a locking block and handle assembly releasably engageable with the handcuff receiver and locking assembly. The locking block and handle assembly includes a locking block member releasably engageable with the handcuff receiver and locking assembly and having a laterally extended main guide handle member. The main guide handle member is provided with a hand grasp section with a hand access slot therein operable to receive the hand and finger area of a security restraining person or user to provide leverage control of the person being restrained due to pressure to be applied against the wrist area of the person being restrained. The locking block member without a main guide handle member connected thereto can be utilized and releasably attached to the handcuff receiver and locking assembly mounted about a portion of the handcuff assembly. The locking block member and the handcuff receiver and locking assembly includes aligned slots therein to receive a security chain assembly therein to interlock and connect adjacent ones of persons being restrained and providing a safety feature for the security restraining person or user thereof.

18 Claims, 4 Drawing Sheets

HANDCUFF ESCORT ASSEMBLY

PRIOR ART

A patent search revealed the following United States patents:

| Patent No. | Invention | Inventor |
|---|---|---|
| 3,616,665 | HANDCUFF SHIELD | Samuel N. Rosenthal |
| 3,740,977 | HANDCUFF COVER ASSEMBLY | Stefansen et al |
| 4,741,051 | PROTECTIVE MITT FOR USE WITH HANDCUFFS | Kenneth G. Bible |
| 4,840,048 | HANDCUFF RESTRAINING APPARATUS AND METHOD OF USE | Dennis C. Elam |
| 4,964,419 | KEYLESS HANDCUFFS | Roy L. Karriker |
| 5,007,257 | SAFETY SHIELD FOR DOUBLE-LOCK HANDCUFFS | Charles E. Thompson |
| 5,233,848 | HANDCUFF RESTRAINING APPARATUS | Dennis C. Elam |

The Rosenthal patent discloses a handcuff shield usable to enclose a handcuff linkage chain between two handcuff bracelet members.

The Stefansen et al patent discloses a handcuff cover assembly operable to receive and enclose conventional handcuffs to restrain hand movement of a person wearing the handcuffs for safety reasons.

The Bible patent discloses a protective mitt for use with handcuffs being a cover to restrain movement of hands of a person wearing the handcuffs.

The Elam U.S. Pat. No. 4,840,048 discloses a handcuff restraining apparatus and method of use having a rigid cover member between bracelet members on a conventional handcuff assembly.

The Karriker patent discloses the use of keyless handcuffs formed of a lightweight plastic material.

The Thompson patent discloses a safety shield for double-lock handcuffs which provides for an officer's safety.

The Elam U.S. Pat. No. 5,233,848 discloses a handcuff restraining apparatus which is substantially identical to the first above noted Elam patent except having a rectangular opening therein whereupon a user's body chain can be trained therethrough.

PREFERRED EMBODIMENT OF THE INVENTION

In one preferred embodiment of this invention, a handcuff escort assembly is provided to be utilized with 1) a conventional handcuff assembly; or 2) an economical handcuff assembly. The handcuff escort assembly is operable to engage the respective handcuff assembly after it is placed about a wrist area of a person being restrained.

The handcuff escort assembly is provided with a locking block and handle assembly having a main guide handle member so that a person being restrained by the handcuff assembly can be controlled and guided by the main guide handle member while being taken to court for legal proceedings and other similar purposes.

Further, the handcuff escort assembly is provided with aligned slots operable to receive a portion of a body chain therethrough to further aid in the confinement and control of the person being restrained plus added safety and security to an officer escorting the person being restrained.

The conventional handcuff assembly is provided with a restraining connector chain member mounted between a pair of spaced handcuff bracelet members. The handcuff bracelet members are of a conventional structure having a stationary bracelet portion with a one-way lock portion pivotally connected thereto. The one-way lock portion is pivotal about the stationary bracelet portion from an unlocked to a locked condition on movement in one direction. A key is used to unlock the respective handcuff bracelet members from the wrist area of the person being restrained.

The economical handcuff restraining assembly is provided with a handcuff receiver support member with a pair of flexible disposable handcuff members connected thereto. The handcuff receiver support member is constructed of a rigid plastic material and provided with a main support body having a pair of adjacent parallel handcuff receiver slots therein to receive respective ones of the flexible disposable handcuff members therein.

The handcuff receiver support member is provided with handcuff severance slots on opposite sides thereof operable to provide access with a knife member to the flexible disposable handcuff members. One of the flexible disposable handcuff members would be severed when disconnecting the flexible disposable handcuff member from the wrist area of the person being restrained.

Each flexible disposable handcuff member is a plastic strap member having a lock head section integral with a main body section which, in turn, is integral with a connector lock section. Each connector lock section is mounted within a lock head section of the other flexible disposable handcuff member and movable only in one direction which is a known one-way locking structure.

The handcuff escort assembly includes 1) a handcuff receiver and locking assembly operable to enclose and restrain a portion of the handcuff assembly; 2) a locking block and handle assembly operable to be releasably connected to the handcuff receiver and locking assembly; and 3) a locking block member being engageable with the handcuff receiver and locking assembly when the locking block and handle assembly is not being used.

The handcuff receiver and locking assembly includes 1) a main support body assembly; and 2) a locking plate assembly movably connected to the main support body assembly. The main support body assembly includes 1) a bottom support plate member; 2) a spacer body member connected to the bottom support plate member; and 3) an upper support plate member connected to an opposite side of the spacer body member.

There is formed an entrance opening or slot between the bottom support plate member and the upper support plate member leading to a cuff support cavity operable to receive a portion of the handcuff assembly therein in a locking manner as will be explained.

The bottom support plate member is provided with an irregular recess section to receive the locking plate assembly therein which is selectively movable from a released to a handcuff locked condition as will be noted.

The bottom support plate member and the upper support plate member are provided with a plurality, namely three, pin guide holes and a chain receiver slot which are aligned respectively with each other.

The locking plate assembly is provided with a lock plate member having a pair of lock pin members and a guide actuator pin member extended from one side thereof. The locking plate assembly further includes a pin bias assembly connected to the guide actuator pin member and against an outer surface of the upper support plate member.

The lock pin members, being two thereof, are extended through the pin guide holes in the bottom and upper support plate members being operable to provide a removable locking structure across the entrance opening or slot into the cuff support cavity for reasons to be noted.

The pin bias assembly includes a bias member mounted about the guide actuator pin member and a nut member secured to an outer end of the guide actuator pin member. The bias member provides for bias of the entire lock plate member towards the locked condition as noted in FIGS. 7 and 8.

The lock plate member is provided with a chain access slot therein which is aligned with the chain receiver or connector slots in the bottom and upper support plate members to receive a portion of a security chain assembly therethrough.

The locking block and handle assembly includes 1) a locking block member; and 2) a main guide handle member connected to the locking block member. The locking block member includes a main block body having two pairs of cooperating spaced block lock openings or holes therein with each pair associated with a chain transfer slot.

The groups of two block lock openings or holes and a respective chain transfer slot are operable to provide adjustable movement in the cuff support cavity when used with the conventional handcuff assembly as noted in FIG. 2 or the economical handcuff assembly as noted in FIG. 3.

The main block body is provided with a front or locking wall integral at outer ends with retainer inclined walls operable to engage and restrain lateral movement of the handcuff assembly being contained in the cuff support cavity.

The main guide handle member is provided with a block connector section secured to or integral with a back side of the locking block member and having integral therewith a handle grasp section. The handle grasp section includes a grasp plate portion extended about a hand access slot and having outer leverage end portions.

As noted in FIG. 1, the hand access slot is operable to receive hand and finger portions of the user thereof in order to control movement of the handcuff receiver and locking assembly by twisting of the handle grasp section to control and guide movement of the person being restrained by the handcuff escort assembly of this invention.

As noted in FIG. 5, the locking block member can be provided without the main guide handle member and utilized to lock the handcuff assembly to the person being restrained. The locking block member allows a portion of the security chain assembly to be extended through the aligned chain receiver or connector slots in the bottom and upper support plate members and the respective chain transfer slot in the locking block member so that a group of people being restrained can be joined together when so required.

The locking plate assembly can be depressed by movement of the guide actuator pin member and moved against the force of the pin bias assembly to move the lock pin members transversely of the cuff support cavity. At this time, the locking block member or the locking block and handle assembly can be moved laterally of the entrance opening or slot and the cuff support cavity so as to remove the locking block member from its engagement with the respective one of the handcuff assembly mounted therein.

OBJECTS OF THE INVENTION

One object of this invention is to provide a handcuff escort assembly usable with a conventional handcuff assembly or an economical handcuff assembly in order to enclose and anchor a portion of the subject handcuff assembly and having a locking block and handle assembly with a main guide handle member to be grasped by a user thereof in order to control and move a person being restrained to and from a courthouse or other location while providing safety features to the subject user.

Another object of this invention is to provide a handcuff escort assembly having a handcuff receiver and locking assembly with a locking plate assembly connected thereto being operable to provide a lock member across an entrance opening into a cuff support cavity and provided with an aligned chain receiver slot, a chain connector slot, and a chain access slot which are operable to receive a body connector chain member therethrough to provide security when escorting a plurality of interconnected persons being restrained.

One other object of this invention is to provide a handcuff escort assembly readily attachable to a portion of a handcuff assembly mounted on a person being restrained in order to limit movement of the person's wrist area and providing means for a security person to guide the person being restrained through a locking block and handle assembly connected to the handcuff assembly.

A further object of this invention is to provide a handcuff escort assembly operable to receive a handcuff assembly of various types being 1) a conventional handcuff assembly with handcuff bracelets interconnected by chain links; or 2) an economical handcuff assembly having a handcuff receiver support member operable to receive flexible plastic disposable handcuff members therein for attachment to the wrist area of a person being restrained.

One further object of this invention is to provide a handcuff escort assembly utilized with an economical handcuff assembly having a handcuff receiver support member with a pair of flexible disposable handcuff members mounted thereon which are connected to the wrist area of a person being restrained and the handcuff receiver support member having handcuff severance slots therein which can be used with a sharp instrument to sever the flexible disposable handcuff members when being removed from the wrist area of the person being restrained.

Still, one other object of this invention is to provide a handcuff escort assembly being readily attached and releasable from a handcuff assembly on a person being restrained which is economical to manufacture; sturdy in construction; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
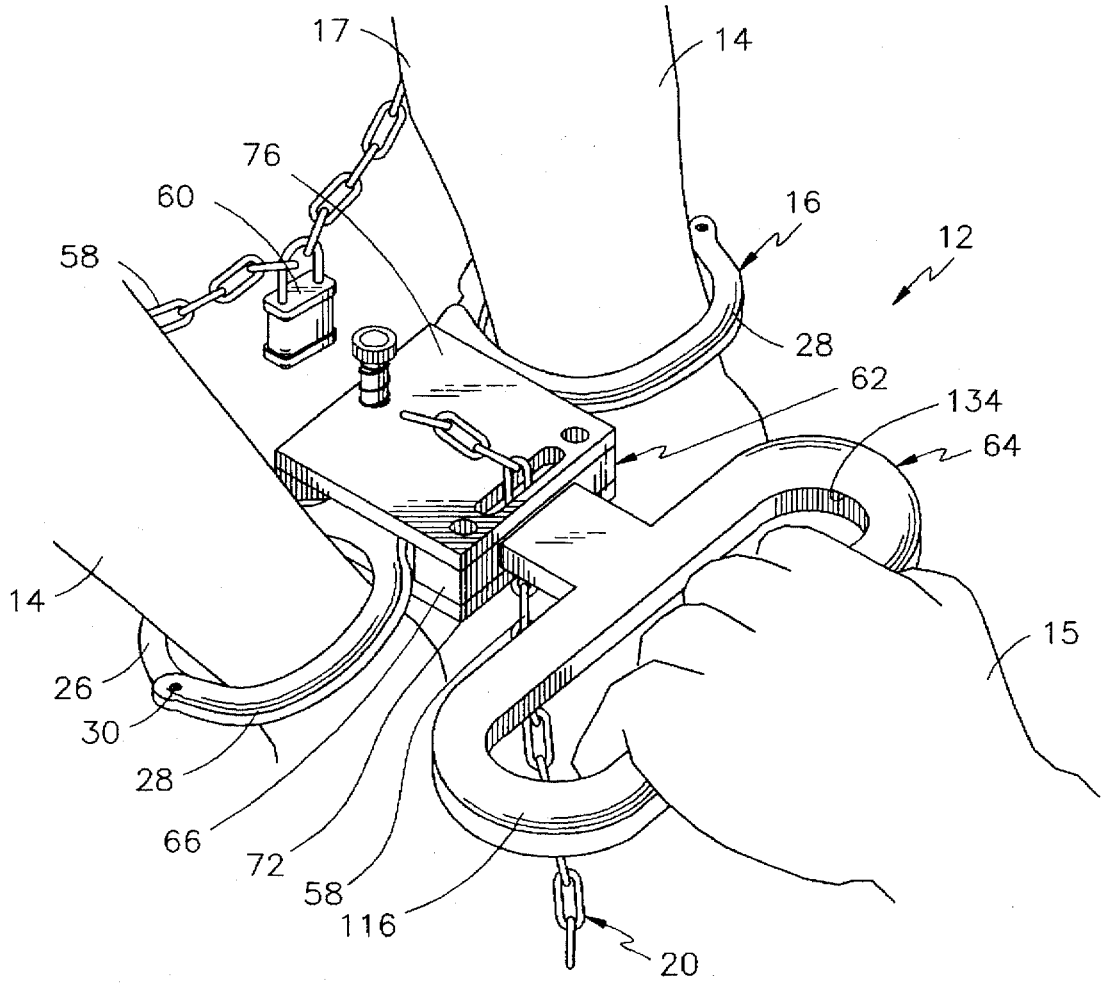
FIG. 1 is a perspective view of the handcuff escort assembly of this invention as mounted about a conventional handcuff assembly on a wrist area of a person being restrained and utilized with a security chain assembly.

The following is a discussion and description of preferred specific embodiments of the handcuff escort assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a handcuff escort assembly of this invention, indicated generally at 12, is shown as utilized with a conventional handcuff assembly 16 to be mounted about a wrist area 14 of a person 17 being restrained and being usable with a security chain assembly 20.

Figure 2:
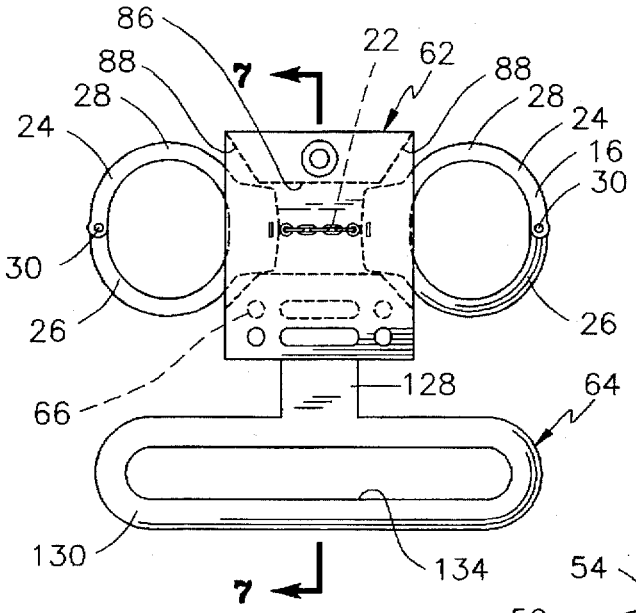
FIG. 2 is a top plan view of the handcuff escort assembly as attached to a conventional handcuff assembly.

As shown in FIG. 2, the conventional handcuff assembly 16 is provided with a restraining or connector chain member 22 interconnecting a pair of spaced handcuff bracelet members 24. Each handcuff bracelet member 24 is provided with a one-way lock portion 26 having lock teeth members thereon which are engageable with a stationary bracelet portion 28 in a known locking manner.

In other words, the one-way lock portion 26 is pivotal about a pivot shaft 30 to provide a locking means and only pivotal in one direction to achieve the locking feature which can be unlocked with a key member in a conventional manner.

Figure 3:
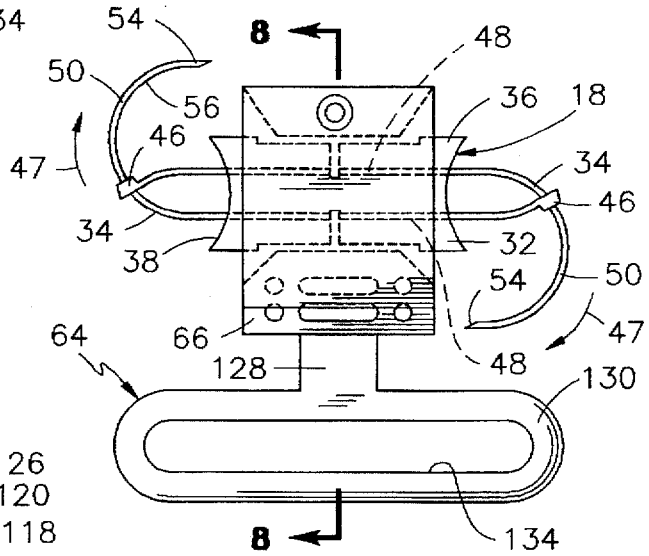
FIG. 3 is a view similar to FIG. 2 of the handcuff escort assembly as utilized with an economical handcuff assembly.
Figure 4:
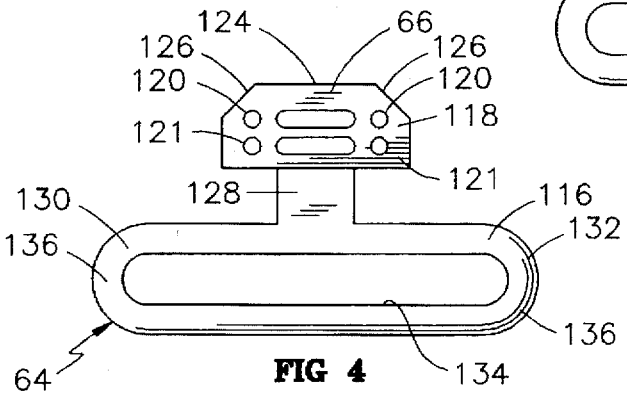
FIG. 4 is a top plan view of a locking block and handle assembly of the handcuff escort assembly of this invention.

As shown in FIG. 3, an economical handcuff restraining assembly 18 includes 1) a handcuff receiver support member 32; and 2) a pair of flexible disposable handcuff members 34 mounted within the handcuff receiver support member 32 to be enclosed and supported therein.

The handcuff receiver support member 32 is preferably of a rigid plastic construction having 1) a main support body 36 with outer arcuate wrist contact end sections 38; 2) a pair of spaced parallel handcuff receiver slots 40 to receive respective ones of the flexible disposable handcuff members 34 therein; and 3) a pair of handcuff severance slots 44, each one associated with a respective one of the handcuff receiver slots 40.

The handcuff severance slots 44 are operable for utilizing a sharp knife to access the flexible disposable handcuff members 34 in order to sever same when it is desirable to remove the flexible disposable handcuff members 34 from the wrist area 14 of the person 17 being restrained.

Each flexible disposable handcuff member 34 is of a generally conventional known plastic locking strap being movable in one direction to a locked condition and normally requiring the severance thereof to remove from an object to which it is attached.

More specifically, each flexible disposable handcuff member or locking strap 34 is provided with a lock head section 46 integral with a main body section 48 which, in turn, is integral with a connector lock section 50.

The lock head section 46 is provided with internal one-way serrations therein to permit longitudinal movement of the connector lock section 50 therein as noted by arrows 47 in FIG. 3 but prevent movement in an opposite direction. Each connector lock section 50 is provided with a tapered end portion 54 to be trained through the lock head section 46 and further having one-way lock projections 56 thereon.

The one-way lock projections 56 are engageable with the one-way serrations in the lock head sections 46 so as to be movable in one direction to decrease the size of an opening between the cooperating flexible disposable handcuff members 34 to be locked about the wrist area 14 of the person 17 being restrained.

The security chain assembly 20 includes a connector chain member 58 with numerous interconnected links and being utilized with a lock member 60 being a padlock for connection to the waist area of the person 17 being restrained as noted in FIG. 1.

Figure 5:
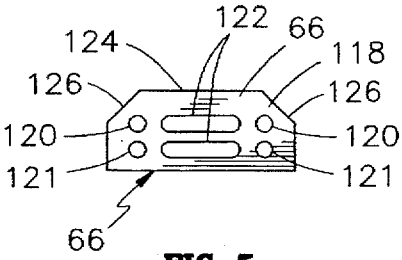
FIG. 5 is a top plan view of a locking block member of this invention.
Figure 6:
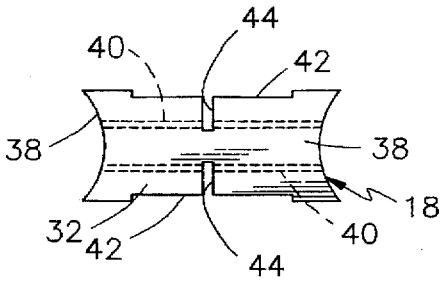
FIG. 6 is a top plan view of a handcuff receiver support member of the economical handcuff assembly.

The handcuff escort assembly 12 includes 1) a handcuff receiver and locking assembly 62; 2) a locking block and handle assembly 64 operable to be releasably connected to the handcuff receiver and locking assembly 62; and 3) a locking block member 66, as noted in FIG. 5, which can be utilized with the handcuff receiver and locking assembly 62 without the locking block and handle assembly 64 in a manner to be explained.

The handcuff receiver and locking assembly 62 includes 1) a main support body assembly 68; and 2) a locking plate assembly 70 which is mounted on the main support body assembly 68 and movable from a locked position to anchor the conventional handcuff assembly 16 or the economical handcuff assembly 18 therewith as will be explained.

Figure 9:
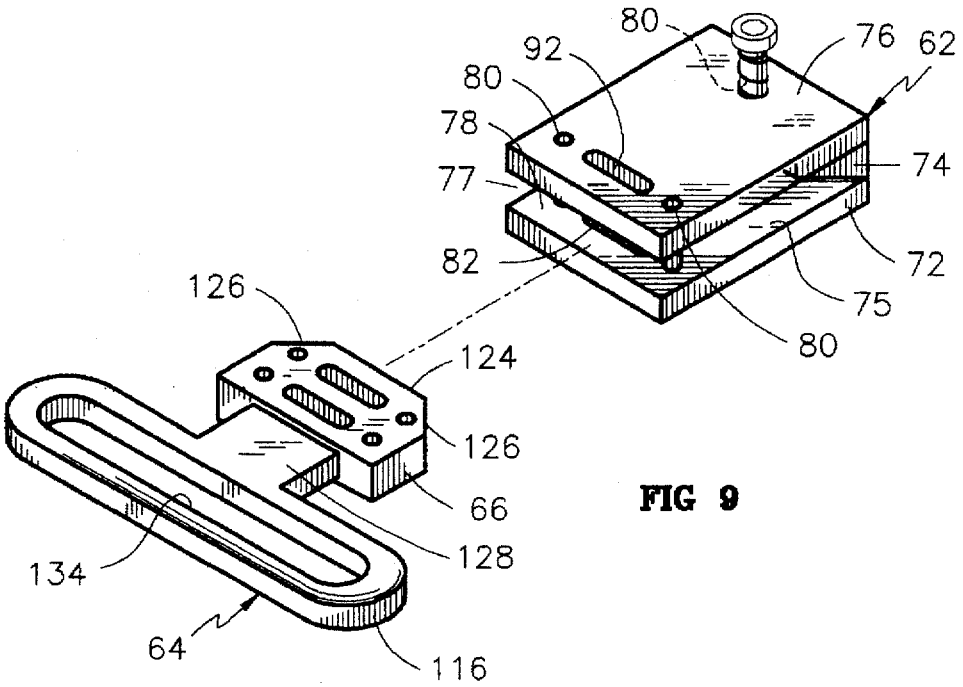
FIG. 9 is an exploded perspective view of the handcuff escort assembly.

As shown in FIG. 9, the main support body assembly 68 includes 1) a bottom support plate member 72; 2) a spacer body member 74 connected to an upper side of the bottom support plate member 72; and 3) an upper support plate member 76 secured to an opposite side of the spacer body member 74. The bottom and upper support plate members 72, 76 define therebetween an entrance opening or slot 77 leading into a cuff support cavity 75.

Figure 10:
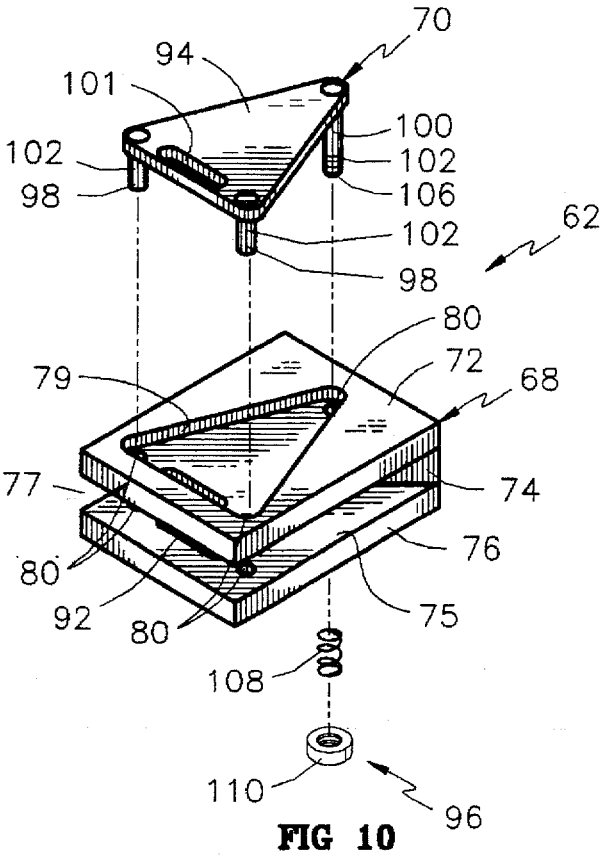
FIG. 10 is an exploded perspective view of a handcuff receiver and locking assembly of the handcuff escort assembly of this invention.

The bottom support plate member 72 is of a plate construction having 1) a rectangular body section 78; 2) an irregular recessed section 79; 3) a plurality of pin guide holes 80, namely three thereof; and 4) a chain receiver slot 82 (FIGS. 9 and 10).

The spacer body member 74 is provided with a guide pin hole 84 having a front wall 86 integral with inclined retainer walls 88. The front wall 86 is operable to contact and engage a portion of the handcuff assembly 16 or 18 being utilized therewith as will be noted.

The inclined retainer walls 88 are engageable with a portion of the handcuff assemblies 16 or 18 to hold a portion thereof within the cuff support cavity 75 in a restraining manner.

The upper support plate member 76 is provided with 1) pin guide holes 80, being three thereof, to align with the similar pin guide holes 80 in the bottom support plate member 72; and 2) having a chain connector slot 92 aligned with the chain receiver slot 82 to receive a portion of the security chain assembly 20 therethrough as noted in FIG. 1.

Figure 8:
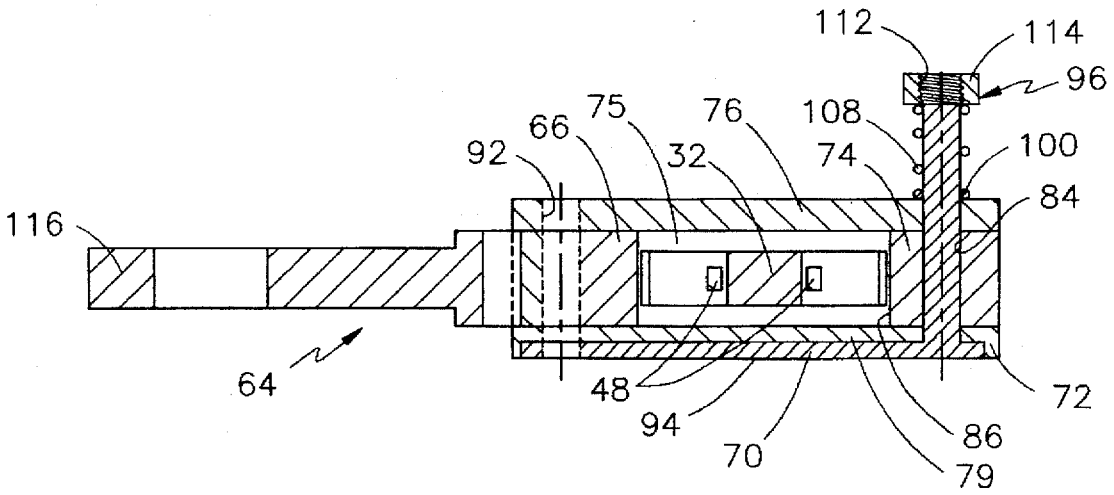
FIG. 8 is an enlarged sectional view taken along line 8—8 in FIG. 3.

As noted in FIG. 10, the locking plate assembly 70 includes 1) an irregular lock plate member 94 adapted to be supported within the irregular recess section 79 in the bottom support plate member 72; and 2) a pin bias assembly 96 engageable with an upper outer surface of the upper support plate member 76 (FIG. 8).

The irregular lock plate member 94 is provided on an inner surface thereof with 1) a pair of spaced lock pin members 98; 2) a guide actuator pin member 100; and 3) a chain access slot 101.

The lock pin members 98 resemble projecting shafts, each having a cylindrical body section 102 with outer anchor end sections selectively mounted in the pin guide holes 80 in the upper support plate member 76.

The guide actuator pin member 100 is provided with the cylindrical body section 102 and having an outer threaded end portion 106.

The chain access slot 101 is operable to be aligned with the chain receiver slot 82 and the chain connector slot 92 in the respective bottom support plate member 72, and the upper support plate member 76 to receive a portion of the security chain assembly 20 therethrough as noted in FIG. 1.

The pin bias assembly 96 includes a bias member 108 being a compression spring member mounted about the cylindrical body section 102 of the guide actuator pin member 100 and being held thereon by a nut member 110 (FIG. 10). The nut member 110 is provided with a threaded central hole 112 and a grasp section 114 for ease of grasping and moving with the interconnected irregular lock plate member 94 as will be explained. The nut member 110 is threaded on the threaded end portion 106 of the guide actuator pin member 100.

The locking block and handle assembly 64 includes 1) one of the locking block members 66; and 2) a main guide handle member 116 connected to the locking block member 66. The locking block member 66 can be an independent, separate unit as noted in FIG. 5 without the interconnected main guide handle member 116 as noted in FIGS. 1–4.

The locking block member 66 includes a main block body 118 having therein a pair of spaced block lock openings or holes 120, 121, each associated with a respective chain transfer slot 122. The groupings of the block lock openings 120, 121, each pair with a respective chain transfer slot 122, are operable to be utilized with a selected one of the handcuff assemblies 16 or 18 as will be noted.

As shown in FIG. 5, the main block body 118 is provided with a front or locking wall 124 integral at outer edges thereof with retainer inclined walls 126. The retainer inclined walls 126 are operable to retain the respective handcuff assemblies 16 or 18 being utilized therewith as shown in FIGS. 2 and 3.

The main guide handle assembly 116 is provided with 1) a block connector section 128 which is connected to or integral with an outer end wall of the locking block member 66; and 2) a handle grasp section 130 integral with the block connector section 128. The handle grasp section 130 is operable to be grasped by the restraining security person being the user's hand and finger area 15.

More specifically, the handle grasp section 130 is provided with a grasp plate portion 132 having therebetween a hand access slot 134 and outer leverage end portions 136. The large width of the handle grasp section 130 is operable to allow the restraining security person to gain more leverage on pushing and/or twisting movement to control movement of the person 17 being restrained to and from a courthouse, to a witness chair, or other similar desired movement of the person 17 being controlled.

As noted in FIG. 5, the locking block member 66 is provided without the main guide handle member 116 connected thereto. The locking block member 66 is as previously described having the main block body 118 with the pairs of spaced lock block openings or holes 120, 121, each pair associated with a respective one of the chain transfer slots 122.

The locking block member 66 may be used individually in conjunction with the handcuff receiver and locking assembly 62 and the security chain assembly 20. When the person 17 being restrained has its wrist area 14 placed in a frontal position such as when the person 17 being restrained is in a sitting position, the main guide handle member 116 is not necessary but all of the persons 17 being restrained may be interconnected by the security chain assembly 20.

USE AND OPERATION OF THE INVENTION

In the use and operation of the handcuff escort assembly 12 of this invention, it is to be utilized with either the conventional handcuff assembly 16 (FIGS. 1 and 7) or the economical handcuff assembly 18 (FIGS. 3 and 8).

With the conventional handcuff assembly 16 as noted in FIG. 1, it is obvious that the handcuff bracelet members 24 would be mounted about the wrist area 14 of the person 17 being restrained. The handcuff bracelet members 24 are locked on the wrist area 14 by movement of the one-way lock portion 26 relative to the stationary bracelet portion 28.

With the conventional handcuff assembly 16 attached to the wrist area 14 of the person 17 being restrained, it is obvious that the arms of the person 17 being restrained could be placed in a front or back area.

Next, the handcuff escort assembly 12 is detached as shown in FIG. 9 with the locking block and handle assembly 64 removed from the handcuff receiver and locking assembly 62.

In the next step, the security restraining person or user thereof would take the handcuff receiver and locking assembly 62 and depress the guide actuator pin member 100 against the force of the compression spring or bias member 108. This would move the irregular lock plate member 94 outwardly of the recessed section 79 and remove the lock pin members 98 from within the entrance opening or slot 77 and permit access to the cuff support cavity 75.

At this time, the security restraining person or user thereof would move the handcuff receiver and locking assembly 62 and place the cuff support cavity 75 about a central portion of the conventional handcuff assembly 16 to the position as noted in FIG. 2.

Next, the security restraining person would grasp the locking block and handle assembly 64 and slide the locking block member 66 transversely of the entrance opening or slot 77 to place the locking block member 66 within the cuff support cavity 75.

Figure 7:
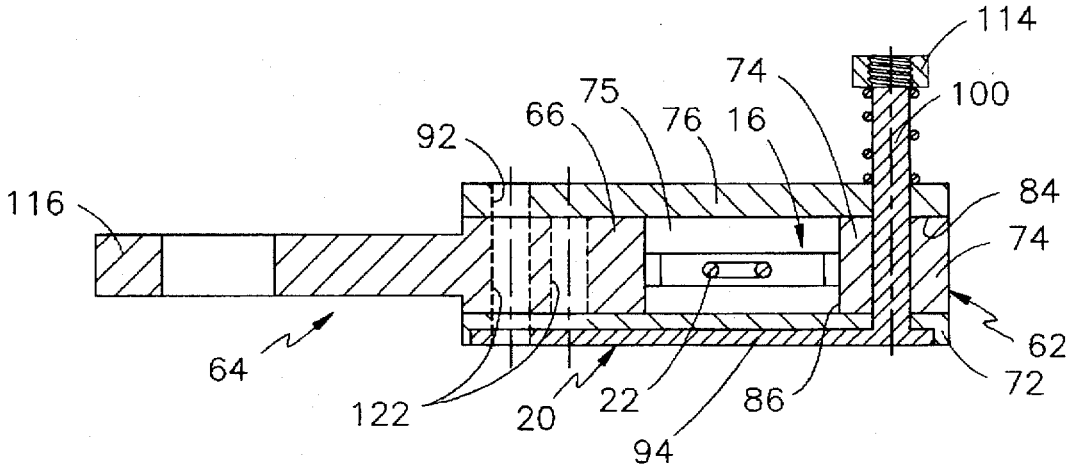
FIG. 7 is an enlarged sectional view taken along line 7—7 in FIG. 2.

On proper positioning thereof, the security restraining person would release pressure against the guide actuator pin member 100 whereupon the bias member 108 would move the irregular lock plate member 94 to the locked position as shown in FIG. 7. This places the lock pin members 98 within the block lock openings or holes 121 and, concurrently, transversely of the pin guide holes 80 in the bottom support plate member 72 and the pin guide holes 80 in the upper support plate member 76.

This causes engagement of the front wall 124 and retainer inclined walls 126 with portions of the handcuff bracelet members 24 of the conventional handcuff assembly 16 to prevent lateral movement and dislodgment from the cuff support cavity 75.

In this connected condition, it is obvious that the security restraining person utilizing the conventional handcuff assembly 16 can control movement of the hand and wrist area 14 of the person 17 being restrained by grasping the main guide handle member 116 whether the conventional handcuff assembly 16 is positioned in front of or behind the person 17 being restrained.

Further, it is noted that the security chain assembly 20 and, more specifically the connector chain member 58, can be trained through the aligned slots in the handcuff receiver and locking assembly 62 and the locking block and handle assembly 64.

More particularly, the connector chain member 58 can be selectively trained through the chain receiver slot 82, the chain connector slot 92, and the chain transverse slots 122 to interconnect various adjacent persons 17 being restrained. The connector chain member 58 can be attached about a waist area of the person 17 being restrained and anchored by the lock member 60 which may be of a conventional padlock structure.

It is to be noted that the handcuff receiver and locking assembly 62 can be utilized with only the locking block member 66 (FIG. 5) as, in certain cases, the main guide handle member 116 is not needed. This is true when a plurality of persons 17 being restrained are interconnected by the security chain assembly 20 with their hands in front and sitting in a pew in a courtroom waiting to be brought before a judge for various legal proceedings.

It is further noted that the handcuff escort assembly 12 can be utilized with the economical handcuff assembly 18 as best shown in FIG. 3. In this case, the handcuff receiver support member 32 with the interconnected flexible disposable handcuff members 34 connected thereto are used.

The respective flexible disposable handcuff members 34 are to be placed about respective ones of the wrist area 14 of the person 17 being restrained. The connector lock section 50 with the tapered end portion 54 is mounted within the respective lock head sections 46 and tightened about the wrist area 14 of the person 17 being restrained. This is possible due to the one-way locking feature on movement of the connector lock section 50 within the lock head section 46 and engagement of the one-way lock projections 56 with the one-way serrations in the lock head sections 46 in a conventional manner.

At this time, the handcuff receiver and locking assembly 62 is moved to the open condition whereupon the handcuff receiver support member 32 is operable to be slid past the entrance opening or slot 77 into the cuff support cavity 75 as noted in FIGS. 3 and 8.

At this time, the locking block and handle assembly 64 is utilized with the locking block member 66 being moved past the entrance opening or slot 77 into the cuff support cavity 75. Then, the pin bias assembly 96 is released to the closed condition which places the lock pin members 98 transversely of the block lock openings or holes 120 and the pin guide holes 80 in the bottom and upper support plate members 72, 76 to the locked condition of FIG. 8.

Also, in this embodiment using the economical handcuff assembly 18, it is obvious that the locking block member 66 in FIG. 5 can be utilized separately or with the attached main guide handle member 116 as noted in FIG. 3.

With use of the economical handcuff assembly 18, it is obvious that, to remove the flexible disposable handcuff member 34 from the wrist area 14 of the person 17 being restrained, a sharp instrument such as a knife member is utilized through the handcuff severance slots 44 to sever ones of the respective flexible disposable handcuff members 34. The other flexible disposable handcuff member 34 would be severed so as to be removable completely from the handcuff receiver support member 32.

The handcuff escort assembly 12 of this invention is readily usable with the conventional handcuff assembly 16 or the economical handcuff assembly 18 being readily attached to the wrist area 14 of a person 17 being restrained and having a large and wide main guide handle member 116 which can be grasped and twisted in order to readily and safely control the person 17 being restrained.

Further, the handcuff escort assembly 12 is provided with aligned slots therein to receive a portion of the security chain assembly 20 therein in order to interconnect the plurality of persons 17 being restrained and adding to the safety of the security restraining person utilizing the handcuff escort assembly 12 of this invention.

The handcuff escort assembly is sturdy in construction; economical to manufacture; easy to use without training or skill required to do so; and substantially maintenance free.

While the invention has been described in conjunction with preferred specific embodiments thereof, it will be understood that this description is intended to illustrate and not to limit the scope of the invention, which is defined by the following claims:

We claim:

1. A handcuff escort assembly adapted for use with a conventional handcuff assembly having a pair of handcuff bracelets interconnected by chain links, comprising:

a) a handcuff receiver and locking assembly including a main support body assembly having a locking plate assembly connected thereto;

b) said main support body assembly having upper and lower plate members defining a cuff receiver slot therebetween leading to a cuff support cavity to receive and enclose chain links and a portion of spaced handcuff bracelets connected to the chain links therein;

c) said locking plate assembly includes a lock plate member having a lock pin connected thereto;

d) said lock pin selectively movable to a first position laterally of said cuff support cavity in order to add or remove a handcuff assembly transversely of said cuff receiver slot and to a second position transverse of said cuff support cavity to secure the handcuff assembly therein;

e) said locking plate assembly includes a pair of said lock pins extended transversely of said cuff support cavity; and f) said locking plate assembly includes a guide actuator pin member connected to a pin bias assembly to bias said locking plate assembly towards an enclosed locked condition and movable by depression of said side actuator pin member to a released condition in order to remove the handcuff assembly from said cuff support cavity.

2. A handcuff escort assembly adapted for use with an economical handcuff restraining assembly having flexible handcuff members used with a handcuff receiver support member, comprising:

a) a handcuff receiver and locking assembly including a main support body assembly having a locking plate assembly connected thereto;

b) said main support body assembly includes a cuff support cavity to receive and enclose a portion of a handcuff receiver support member having flexible handcuff members connected thereto;

c) said locking plate assembly includes a lock plate member connected thereto; and d) said lock plate member movable to a first position laterally of said cuff support cavity in order to add or remove the handcuff receiver support member and interconnected said flexible handcuff members therefrom and to a second position transverse of said cuff support cavity to secure said handcuff receiver support member therein.

3. A handcuff escort assembly as described in claim 2, wherein:

a) said lock plate member includes a pair of lock pin members and a guide actuator pin member; and b) said lock pin members extended transversely of said cuff support cavity operable to prevent movement of said handcuff receiver support member laterally of said cuff support cavity.

4. A handcuff escort assembly as described in claim 2, including:

a) a locking block member mounted within said cuff support cavity and releasably engageable with said lock plate member to hold said handcuff receiver support member and interconnected said flexible handcuff members within said cuff support cavity.

5. A handcuff escort assembly as described in claim 4, including:

a) a main guide handle member connected to said locking block member; and b) said main guide handle member having a hand grasp section with a hand receiving access slot therein with said hand grasp section operable to be grasped by a person utilizing same to control movement of said handcuff receiver and locking assembly and an interconnected handcuff assembly mounted therein.

6. A handcuff escort assembly as described in claim 4, wherein:

a) said locking block member having a main block body provided with block lock openings and a chain transfer slot; and b) said chain transfer slot operable to be aligned with chain slots in said handcuff receiver and locking assembly to receive a portion of a security chain assembly therethrough for interconnecting adjacent persons being restrained to the common security chain assembly.

7. A handcuff escort assembly as described in claim 4, wherein:

a) said locking plate assembly includes a lock plate member having a guide actuator pin member with a pin bias assembly connected thereto; and b) said pin bias assembly includes a bias member mounted about said guide actuator pin member and operable to bias said lock plate member to a locked, closed condition whereupon axial movement of said guide actuator pin member against the spring bias of said bias member operates to move said lock plate member transversely of said cuff support cavity to allow removal of said locking block member and the handcuff assembly therefrom.

8. A handcuff escort assembly as described in claim 2, including:

a) a locking block member having a pair of spaced block lock openings;

b) said locking block member selectively mounted transverely of said cuff suport cavity; and c) said lock plate member having a pair of lock pin members releasably mounted in respective ones of said block lock openings when in a secured condition.

9. A handcuff escort assembly as described in claim 8, wherein:

a) said locking block member having a chain access slot operable to be aligned with chain slots in said handcuff receiver and locking assembly to receive a security chain member therethrough to interconnect adjacent persons being restrained.

10. A handcuff escort assembly as described in claim 2, wherein:

a) said handcuff receiver support member includes a handcuff receiver slot to receive and support a portion of the flexible handcuff member therein and a handcuff severance slot intersecting said handcuff receiver slot;

whereby the flexible handcuff member can be selectively severed for removal from said handcuff receiver support member by inserting a sharp instrument through said handcuff severance slot and severing the flexible handcuff member.

11. A handcuff control assembly adapted for use with a conventional handcuff assembly or an economical handcuff restraining assembly, comprising:

a) a handcuff receiver and locking assembly including a main support body assembly with a locking plate assembly connected thereto;

b) said main support body assembly includes a bottom support plate member connected to an upper support plate member and defining a cuff support cavity having a cuff receiver slot therebetween;

c) said locking plate assembly includes a lock plate member having a lock pin member connected thereto and selectively movable transversely of said cuff support cavity to add or remove a portion of a handcuff assembly therefrom through said cuff receiver slot; and d) a locking block member selectively mounted through said cuff receiver slot in said cuff support cavity and selectively engageable with said lock pin member to anchor the handcuff assembly in said cuff support cavity.

12. A handcuff control assembly as described in claim 11, wherein:

a) said locking plate assembly having a pair of said lock pin members connected to said lock plate member;

b) said locking block member having a pair of block lock openings to receive said lock pin members in respective ones thereof and having a chain transfer slot therein; and c) said bottom support plate member and said upper support plate member, each having a chain connector slot therein to be aligned with said chain transfer slot in said locking block member;

whereby a portion of a security chain member is mountable within said aligned chain connector slots and said chain transfer slot so as to be interconnected to a waist area of a person being restrained and to adjacent ones of a plurality of persons being restrained.

13. A handcuff control assembly as described in claim 11, wherein:

a) said locking plate assembly includes a guide actuator pin member mounted through openings in said bottom support plate member and said upper support plate member and having a pin bias assembly connected to said guide actuator pin member; and b) said pin bias assembly includes a spring member mounted about said guide actuator pin member operable to hold said lock plate member in a locked condition wherein movement of said guide actuator pin member against bias of said pin bias assembly moves said lock pin member transversely of said cuff support cavity to allow removal of said locking block member therefrom and the handcuff assembly therefrom.

14. A handcuff control assembly as described in claim 11, including:

a) a main guide handle assembly secured to said locking block member; and b) said main guide handle assembly having a handle grasp portion with a handle access slot so as to be grasped by a person utilizing same in order to maintain and control movement of the person being restrained through movement of said handle grasp section.

15. A handcuff control assembly as described in claim 14, wherein:

a) said handle grasp section extended substantially laterally of said locking block member with outer leverage end portions to provide leverage to the person utilizing same for twisting movement of said locking block member and said handcuff receiver and locking assembly connected thereto.

16. A handcuff control assembly as described in claim 11, wherein:

a) said bottom support plate member, said upper support plate member, said lock plate member, and said locking block member, each having a slot therein; and b) all of said slots are selectively aligned to receive a portion of a connector chain member therethrough for interconnection of adjacent persons being restrained.

17. A handcuff control assembly as described in claim 11, wherein:

a) said locking block member includes a pair of spaced openings, each having a chain slot associated therewith;

b) said locking plate assembly includes a pair of said lock pin members; and c) said lock pin members to be selectively placed in one of said pairs of said spaced openings depending on size and type of handcuff assembly being used.

18. A handcuff escort assembly adapted for use with a conventional handcuff assembly having a pair of handcuff bracelets interconnected by chain links, comprising:

a) a handcuff receiver and locking assembly including a main support body assembly having a locking plate assembly connected thereto;

b) said main support body assembly having upper and lower plate members defining a cuff receiver slot therebetween leading to a cuff support cavity to receive and enclose chain links and a portion of spaced handcuff bracelets connected to the chain links therein;

c) said locking plate assembly includes a lock plate member having a lock pin connected thereto;

d) said lock pin selectively movable to a first position laterally of said cuff support cavity in order to add or remove a handcuff assembly transversely of said cuff receiver slot and to a second position transverse of said cuff support cavity to secure the handcuff assembly therein;

e) a locking block member operable to be placed within or removed from said cuff support cavity through said cuff receiver slot and releasably locked therein to restrict movement of the handcuff bracelets and interconnected chain links; and f) a main guide handle member connected to said locking block member and having a handle grasp section with a hand access slot to be grasped by a restraining security person in order to maintain control over movement of said handcuff receiver and locking assembly and the interconnected chain links and handcuff bracelets mounted therein.

* * * * *